US005758791A

United States Patent [19]

Mangla

[11] Patent Number: 5,758,791

[45] Date of Patent: Jun. 2, 1998

[54] LATCHING MECHANISM FOR A PLASTIC CONTAINER

[75] Inventor: Raj K. Mangla, Pittsford, N.Y.

[73] Assignee: Tenneco Packaging Inc., Evanston, Ill.

[21] Appl. No.: 692,579

[22] Filed: Aug. 5, 1996

[51] Int. Cl.[6] ..... B65D 6/00; B65D 6/38; B65D 8/12

[52] U.S. Cl. ..... 220/4.21; 220/671; 220/675; 220/780; 220/783; 220/784

[58] Field of Search ..... 220/4.21, 4.22, 220/4.23, 4.24, 783, 791, 793, 794, 780, 305, 797, 657, 659, 671, 675; 206/551; 312/284, 285

[56] References Cited

U.S. PATENT DOCUMENTS

| | | | |
|---|---|---|---|
| D. 272,595 | 2/1984 | Chase et al. . | |
| D. 276,216 | 11/1984 | Michaud . | |
| D. 281,042 | 10/1985 | Antoni et al. . | |
| D. 290,232 | 6/1987 | Holzkopf et al. . | |
| D. 298,791 | 12/1988 | Holzkopf . | |
| D. 305,409 | 1/1990 | Michaud et al. . | |
| D. 341,316 | 11/1993 | Fritz et al. . | |
| D. 352,000 | 11/1994 | Hansen et al. . | |
| D. 358,091 | 5/1995 | Warburton . | |
| 2,798,631 | 7/1957 | Engel | 220/4.21 |
| 4,197,940 | 4/1980 | DeRossett | 312/284 X |
| 4,206,845 | 6/1980 | Christian | 220/4.21 X |
| 4,375,862 | 3/1983 | Kurinsky et al. . | |
| 4,524,882 | 6/1985 | Buc | 220/783 |
| 4,741,452 | 5/1988 | Holzkopf | 220/783 |
| 4,742,934 | 5/1988 | Michaud et al. . | |
| 4,819,824 | 4/1989 | Longbottom et al. | 220/783 X |
| 4,863,058 | 9/1989 | Antoni et al. . | |
| 4,874,083 | 10/1989 | Antoni et al. . | |
| 4,974,738 | 12/1990 | Kidd et al. . | |
| 5,018,624 | 5/1991 | Arneson et al. . | |
| 5,046,659 | 9/1991 | Warburton . | |
| 5,165,947 | 11/1992 | Colucci et al. | 220/507 X |
| 5,220,999 | 6/1993 | Goulette . | |
| 5,266,763 | 11/1993 | Colombo . | |
| 5,269,430 | 12/1993 | Schlaupitz et al. . | |
| 5,287,959 | 2/1994 | Hansen et al. . | |
| 5,300,748 | 4/1994 | Colombo . | |
| 5,303,839 | 4/1994 | Blumenschein | 220/783 X |
| 5,322,182 | 6/1994 | Fritz . | |
| 5,423,453 | 6/1995 | Fritz . | |
| 5,447,234 | 9/1995 | Faulstick et al. | 220/533 X |
| 5,515,993 | 5/1996 | McManus . | |

OTHER PUBLICATIONS

Tenneco Packaging Product Specification Catalog: Summer, 1996; pp. 3–108.

Brochure: ClearView Price List and MicroView Price List; 1996; 10 pages.

*Primary Examiner*—Allan N. Shoap
*Assistant Examiner*—Niki M. Kopsidas
*Attorney, Agent, or Firm*—Arnold, White & Durkee

[57] ABSTRACT

In a plastic food container including a lid and a base, a latching mechanism includes a first continuous rim along a periphery of the lid and a second continuous rim along a periphery of the base. The first rim includes an inner female member, a central male member, and an outer latching member. The central male member encompasses and is integrally connected to the inner female member, and the outer latching member encompasses and projects laterally outwardly from the central male member. The second rim is adapted to latch with the first rim. The second rim includes an inner male member and an outer female member. The outer female member encompasses and is integrally connected to the inner male member. The outer female member includes an outer peripheral wall forming a plurality of spaced inwardly-projecting tabs.

7 Claims, 4 Drawing Sheets

LATCHING MECHANISM FOR A PLASTIC CONTAINER

FIELD OF THE INVENTION

The present invention relates generally to plastic food containers and, more particularly, relates to a plastic food container having a leak-resistant latching mechanism that remains latched when the container is handled from one end.

BACKGROUND OF THE INVENTION

Plastic containers used to ship and/or sell food products to customers often include a lid and a base. To close such a plastic food container, the lid typically includes a peripheral rim that latches with a corresponding peripheral rim on the base. A drawback of such plastic food containers is that the rims can become unlatched due to bowing when the filled container is lifted from one end, especially if the container is elongated in configuration. Another drawback of such plastic food containers is that the latched rims can allow liquids from a liquid-generating food product within the container to leak out of the container.

A need therefore exists for a plastic food container having a latching mechanism that overcomes the aforementioned drawbacks associated with some existing plastic food containers.

SUMMARY OF THE INVENTION

A plastic food container includes a lid and a base. The lid includes a top wall, a continuous lid wall, and a continuous first rim. The continuous lid wall encompasses the top wall and extends downwardly and outwardly from the top wall. The continuous lid wall forms a first pair of opposing lid side walls and a second pair of opposing lid side walls. The second pair of opposing lid side walls bridge the first pair of opposing lid side walls. The continuous first rim encompasses a lower edge of the continuous lid wall and projects laterally outwardly therefrom. The base includes a bottom wall, a continuous base wall, and a continuous second rim. The continuous base wall encompasses the bottom wall and extends upwardly and outwardly from the bottom wall. The continuous base wall forms a first pair of opposing base side walls and a second pair of opposing base side walls. The second pair of opposing base side walls bridge the first pair of opposing base side walls. The continuous second rim encompasses an upper edge of the continuous base wall and projects laterally outwardly therefrom.

The first and second rims form a latching mechanism for releasably engaging the lid and base to each other. In particular, the first rim includes an inner female member, a central male member, and an outer latching member. The central male member encompasses and is integrally connected to the inner female member. The outer latching member encompasses and projects laterally outwardly from the central male member. The second rim includes an inner male member and an outer female member. The outer female member encompasses and is integrally connected to the inner male member. The outer female member includes an outer peripheral wall forming a plurality of spaced inwardly-projecting tabs. The inwardly-projecting tabs are intermittently located along the outer peripheral wall of the outer female member.

When the first and second rims are latched to each other, the inner female member of the first rim receives the inner male member of the second rim, and the outer female member of the second rim receives both the central male member and the outer latching member of the first rim. The outer latching member latches with the inwardly-projecting tabs to retain the central male member and the outer latching member of the first rim within the outer female member of the second rim. The snap engagement of the tabs with the outer latching member prevent the lid from unlatching due to bowing when the container is filled and held from one end. The engagement of the inner female member and central male member of the first rim with the respective inner male member and outer female member of the second rim provides the container with substantial leak resistance and assists in holding the lid and base together.

BRIEF DESCRIPTION OF THE DRAWINGS

Other objects and advantages of the invention will become apparent upon reading the following detailed description and upon reference to the drawings in which.

Figure 1:
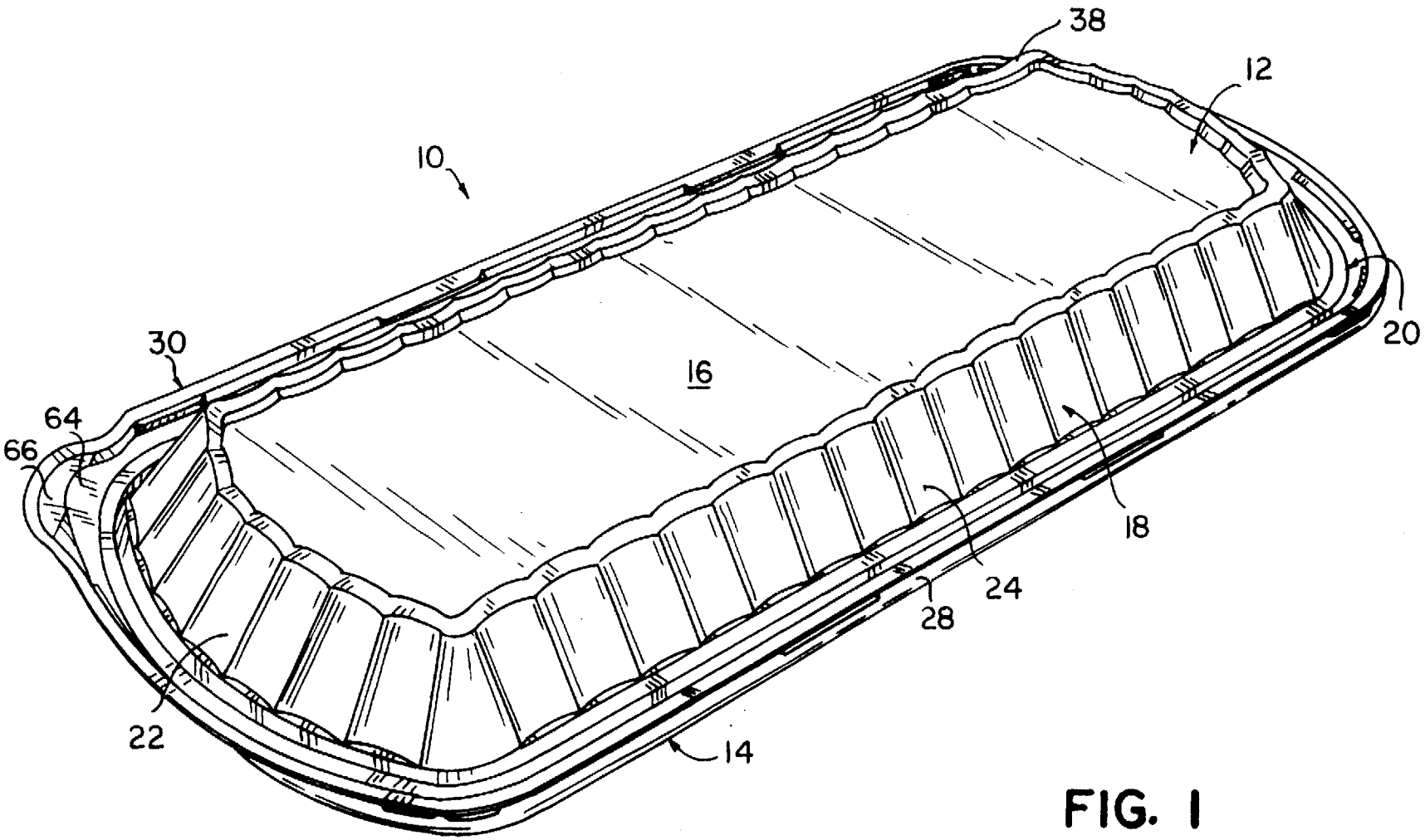
FIG. 1 is a perspective view of a plastic container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to the drawings, FIGS. 1–5 illustrate a plastic food container 10 embodying the present invention. The plastic food container 10 includes a lid 12 and a base 14. The lid 12 includes a top wall 16, a continuous lid wall 18, and a continuous first rim 20. The continuous lid wall 18 encompasses the top wall 16 and extends downwardly and outwardly from the top wall 16. The continuous lid wall 18 forms a first pair of opposing lid side walls 22 and a second pair of opposing lid side walls 24. The second pair of opposing lid side walls 24 bridge the first pair of opposing lid side walls 22. The continuous first rim 20 encompasses a lower edge of the continuous lid wall 18 and projects laterally outwardly therefrom.

The base 14 includes a bottom wall 26, a continuous base wall 28, and a continuous second rim 30. The continuous base wall 28 encompasses the bottom wall 26 and extends upwardly and outwardly from the bottom wall 26. The continuous base wall 28 forms a first pair of opposing base side walls 32 and a second pair of opposing base side walls 34. The second pair of opposing base side walls 34 bridge the first pair of opposing base side walls 32. The continuous second rim 30 encompasses an upper edge of the continuous base wall 28 and projects laterally outwardly therefrom.

The plastic food container 10 includes several rib structures that enhance its structural integrity. First, the bottom wall 26 forms a plurality of zigzag grooves or ribs 36 (FIG. 4) that add beam strength to the elongated container 10. The grooves 36 also serve to collect any excess liquids generated by a food product such as ribs within the container 10. Second, to provide the container 10 with top load compression strength, the continuous lid wall 18 and the continuous base wall 28 include respective ribs oriented in a generally vertical direction. With respect to the continuous lid wall 18, the lid wall 18 forms a plurality of interconnected concave ribs extending between the top wall 16 and the continuous first rim 20. The concave shape of the ribs prevents the continuous lid wall 18 from deflecting outward in response to applying downward force to the lid 12 while latching the continuous first rim 20 of the lid 12 to the continuous second rim 30 of the base 14. With respect to the continuous base wall 28, the base wall 28 forms a plurality of interconnected, semi-cylindrical ribs extending between the continuous second rim 30 and the bottom wall 26. These semi-cylindrical ribs wrap from the continuous base wall 28 to the bottom wall 26 and terminate approximately at the periphery of the bottom wall 26.

To facilitate stacking of multiple containers 10, the top wall 16 forms a raised shoulder 38 (FIGS. 1 and 2) encompassing a recessed region, and the bottom wall 26 likewise forms a corresponding raised shoulder 40 (FIG. 4) encompassing a recessed region. When an upper container 10 is stacked on top of a lower container 10, the inner edge of the raised shoulder 40 on the base 14 of the upper container engages the outer edge of the raised shoulder 38 on the lid 12 of the lower container such that the 25 raised shoulder 38 on the lid 12 of the lower container fits within the recessed region on the bottom wall 26 of the upper container. To further stabilize the stacked containers, the inner edge of the raised shoulder 38 on the lid 12 of the lower container engages marginal portions of the zigzag rib design on the base 14 of the upper container.

Figure 6:
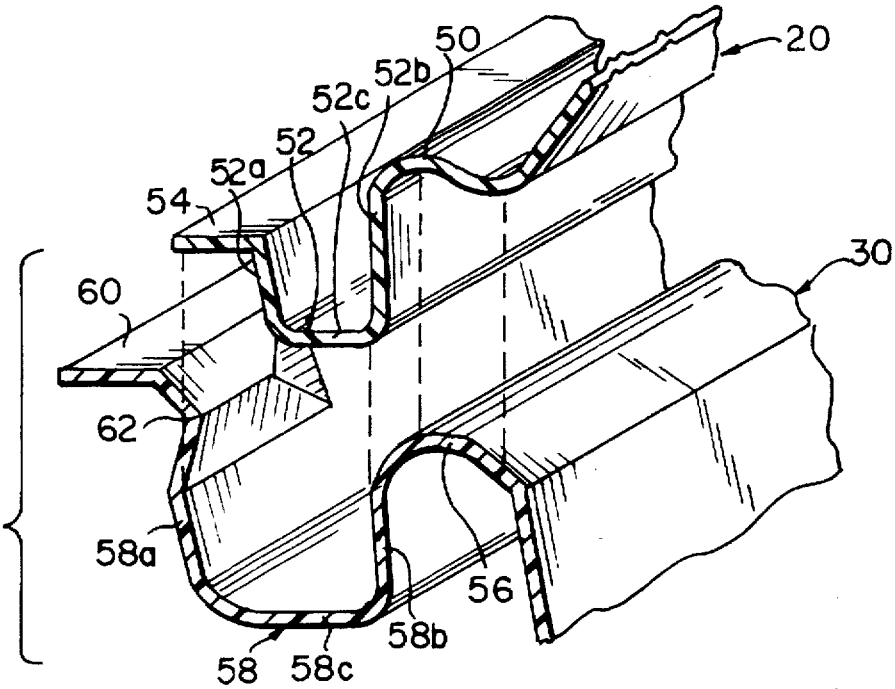
FIG. 6 is a sectional view of a latching mechanism of the plastic container in FIG. 1, showing the locking members of the latching mechanism disengaged from each other.
Figure 7:
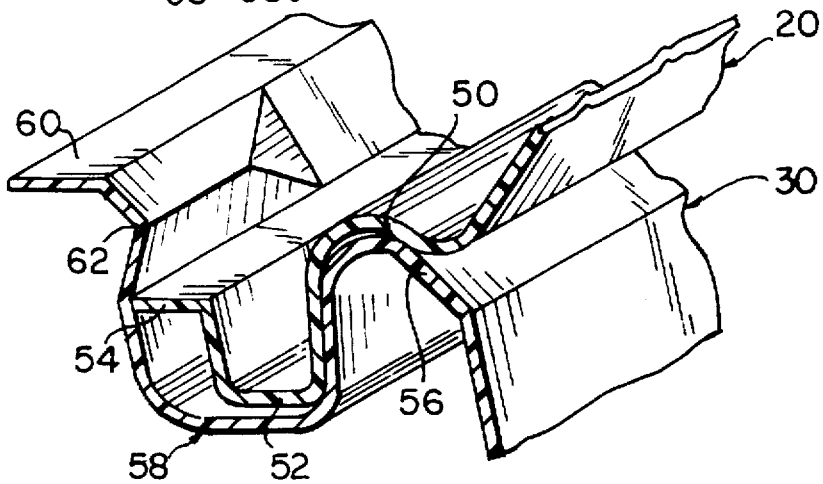
FIG. 7 is a sectional view taken generally along line 7—7 in FIG. 3 showing the locking members of the latching mechanism engaged to each other.
Figure 8:
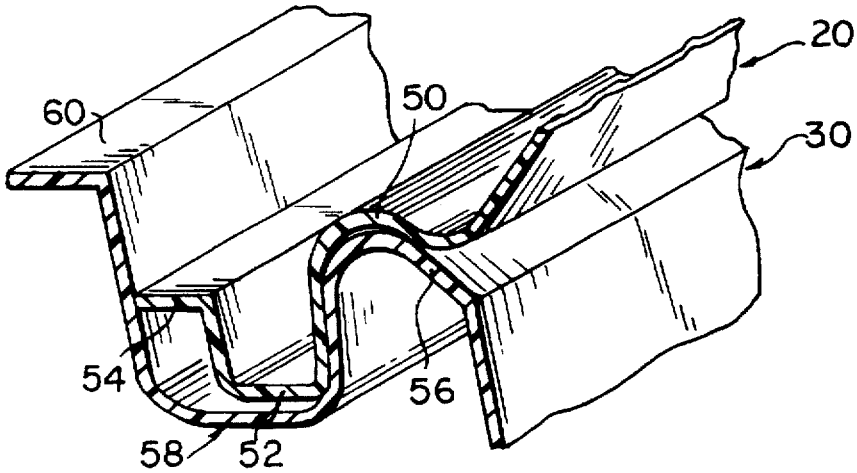
FIG. 8 is a sectional view taken generally along line 8—8 in FIG. 3 showing the locking members of the latching mechanism engaged to each other.

Referring to FIGS. 6–8, the first and second rims 20 and 30 form a latching mechanism for releasably engaging the lid 12 and base 14 to each other. In particular, the first rim 20 includes an arch-shaped inner female member 50, a generally U-shaped central male member 52, and a straight outer latching member 54. The central male member 52 encompasses and is integrally connected to the inner female member 50. The central male member 52 is formed by a pair of generally vertical opposing legs **52*a* and 52*b* (FIG. 6) and a horizontal base portion 52*c* (FIG. 6) extending between the opposing legs. The inner leg 52*b* (right leg as viewed in FIGS. 6–8) of the central male member 52 extends upward and leads directly into the arch-shaped inner female member 50. The outer latching member 54 encompasses and projects laterally outward from the central male member 52. The outer latching member 54 is generally linear in cross-section and is integrally connected to the outer leg 52*a* (left leg as viewed in FIGS. 6–8) of the central male member 52**.

The second rim 30 includes an arch-shaped inner male member 56, a generally U-shaped outer female member 58, and a straight trim area 60. The inner male member 56 is designed to mate with the arch-shaped female member 50 of the rim 20. The outer female member 58 encompasses and is integrally connected to the inner male member 56. The outer female member 58 is formed by a pair of generally vertical opposing legs **58*a* and 58*b* (FIG. 6) and a horizontal base portion 58*c* (FIG. 6) extending between the opposing legs. The inner leg 58*b* (right leg as viewed in FIGS. 6–8) of the outer female member 58 extends upward and leads directly into the arch-shaped inner male member 56. The outer leg 58*a* forms a plurality of spaced inwardly-projecting tabs 62. If the width of the outer female member 58 is distance between the opposing legs 58*a* and 58*b*, the outer female member 58 is sufficiently wide to snugly accommodate both the central male member 52 and the outer latching member 54 of the rim 20. The trim area 60 encompasses and projects laterally outward from the outer female member 58. The trim area 60 is generally linear in cross-section and is integrally connected to the outer leg 58*a* (left leg as viewed in FIGS. 6–8) of the outer female member 58**.

FIG. 6 illustrates the first and second rims 20 and 30 prior to being latched to each other. FIGS. 7 and 8 illustrate the first and second rims 20 and 30 after they have been latched to each other. When the first and second rims 20 and 30 are latched to each other, the inner female member 50 of the first rim 20 receives the inner male member 56 of the second rim 30, and the outer female member 58 of the second rim 30 receives both the central male member 52 and the outer latching member 54 of the first rim 20. The outer latching member 54 latches with the inwardly-projecting tabs 62 to retain the central male member 52 and the outer latching member 54 of the first rim 20 within the outer female member 58 of the second rim 30 below the tabs 62.

The plastic material of the rims 20 and 30 is sufficiently resilient that they flex relative to each other in opposite directions during the latching operation. Specifically, with regard to the rim 20, the outer latching member 54 flexes upward and inward and the leg **52*a* of the central male member 52 flexes inward as the outer latching member 54 bears against and snaps under the tabs 62. With regard to the rim 30, the leg 58*a* of the outer female member 58 flexes outward as the outer latching member 54 of the rim 20 bears against and snaps under the tabs 62**.

The snap engagement of the tabs 62 with the outer latching member 54 prevent the lid 12 from unlatching due to bowing when the container 10 is filled and held from one end. The engagement of the inner female member 50 and central male member 52 of the first rim 20 with the respective inner male member 56 and outer female member 58 of the second rim 30 provides the container 10 with substantial leak resistance and assists in holding the lid 12 and base 14 together.

Figure 2:
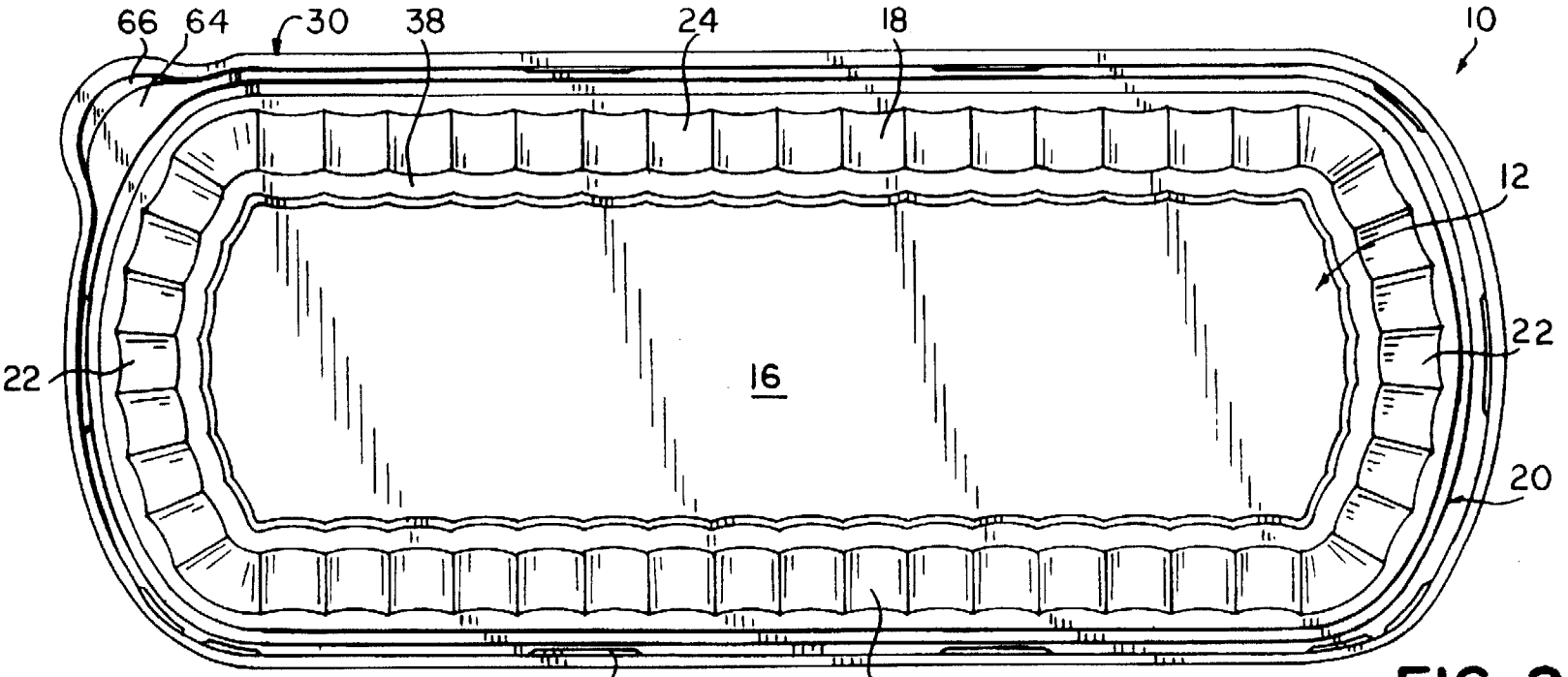
FIG. 2 is a top plan view of the plastic container in FIG. 1.
Figure 3:
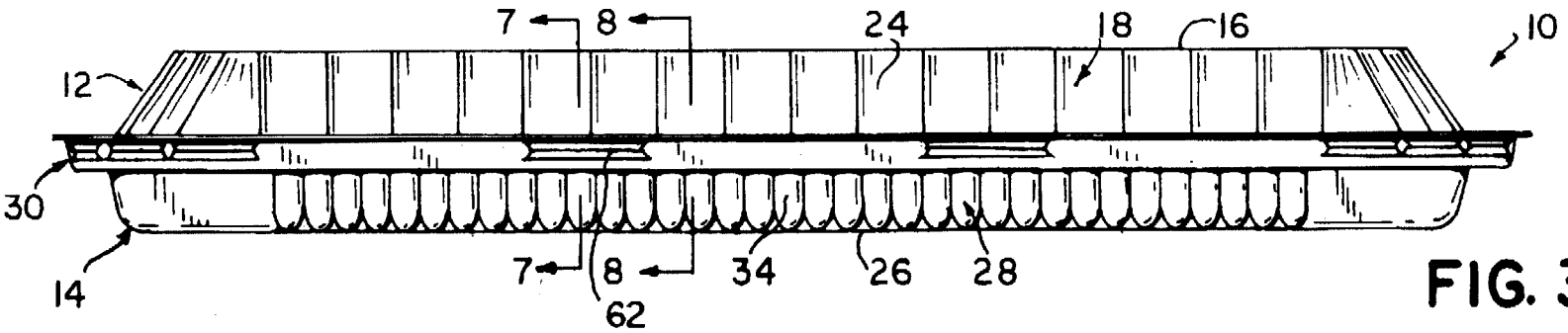
FIG. 3 is a side view of the plastic container in FIG. 1.
Figure 4:
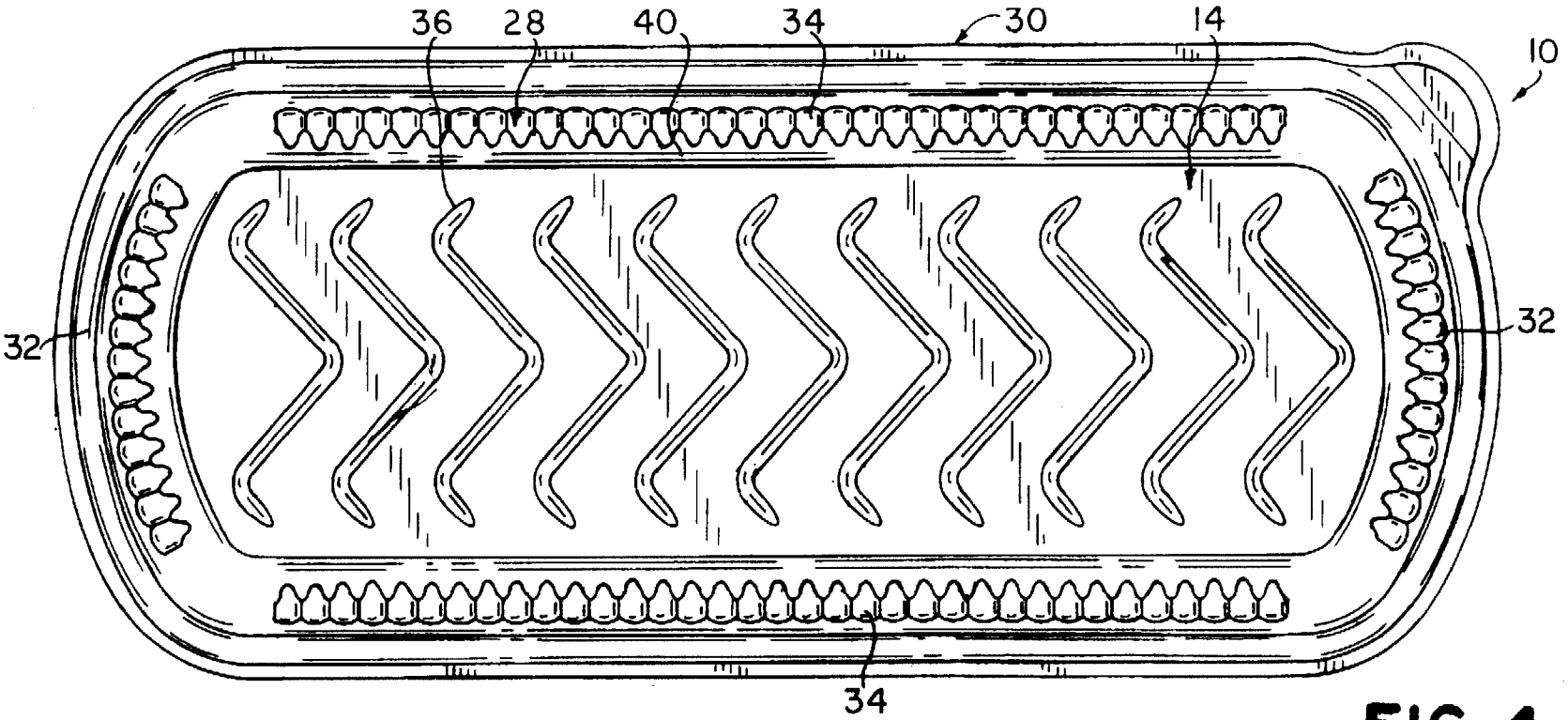
FIG. 4 is a bottom plan view of the plastic container in FIG. 1.
Figure 5:
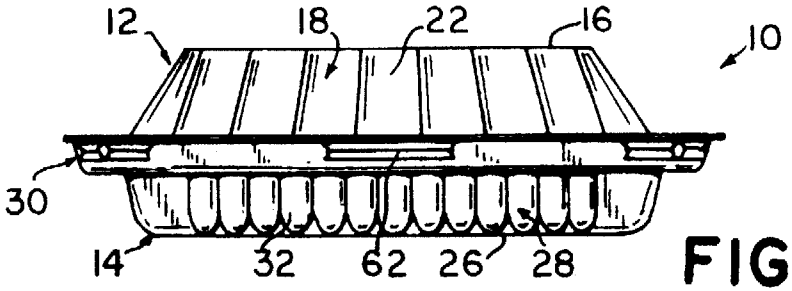
FIG. 5 is an end view of the plastic container in FIG. 1.

To facilitate unlatching of the first and second rims 20 and 30, the first rim 20 forms a trim protrusion 64 and the second rim 30 forms a thumb well 66 (FIGS. 1 and 2). To unlatch the first and second rims 20 and 30, a user plants his or her thumb in the thumb well 66 to hold down the base 14. While holding down the base 14, the user then lifts the protrusion 64 upward away from the thumb well 66 until the first and second rims 20 and 30 are disengaged from each other. Since the lifting force is applied at a comer of the container 10, the first and second rims 20 and 30 may first unlatch at the tabs 62 closest to the corner of the container 10 and subsequently unlatch at other tabs around the periphery of the container 10. Once again, the rims 20 and 30 are sufficiently resilient to facilitate the unlatching operation.

The plastic food container 10 is preferably manufactured using conventional thermoforming techniques. The lid 12 is preferably composed of oriented polystyrene (OPS), polyethylene terephthalate (PET), or a combination thereof The base 14 is preferably composed of polypropylene (PP). Those of ordinary skill in the art will recognize that other polymers or combinations of polymers may be used to thermoform the lid 12 and base 14.

While the present invention has been described with reference to one or more particular embodiments, those skilled in the art will recognize that many changes may be made thereto without departing from the spirit and scope of the present invention. For example, the lid 12 and the base 14 may be interchanged such that the lid 12 serves as a base and the base 14 serves as a lid. Each of these embodiments and obvious variations thereof is contemplated as falling within the spirit and scope of the claimed invention, which is set forth in the following claims.

What is claimed is:

1. In a plastic food container including a lid and a base, a latching mechanism comprising:

a first continuous rim along a periphery of said lid and including an inner female member, a central male member, and an outer latching member, said central male member encompassing and being integrally connected to said inner female member, said outer latching member encompassing and projecting laterally outwardly from said central male member;

a second continuous rim along a periphery of said base and adapted to latch with said first rim, said second rim including an inner male member and an outer female member, said outer female member encompassing and being integrally connected to said inner male member, said outer female member including an outer peripheral wall forming a plurality of spaced inwardly-projecting tabs;

wherein when said first and second rims are latched to each other, said inner female member of said first rim receives said inner male member of said second rim, said outer female member of said second rim receives both said central male member and said outer latching member of said first rim, and said outer latching member of said first rim latches with said inwardly-projecting tabs to retain said central male member and said outer latching member of said first rim within said outer female member of said second rim;

wherein said inner female member of said first rim and said inner male member of said second rim have an arch-shaped cross-section; and wherein said central male member of said first rim and said outer female member of said second rim have a generally U-shaped cross-section.

2. The latching mechanism of claim 1, wherein said central male member of said first rim includes a pair of generally vertical opposing first legs and a horizontal first base portion bridging said opposing first legs, one of said first legs leading directly into said inner female member, the other of said first legs being integrally connected to said outer latching member, and wherein said outer female member of said second rim includes a pair of generally vertical opposing second legs and a horizontal second base portion bridging said opposing second legs, one of said second legs leading directly into said inner male member.

3. The latching mechanism of claim 2, wherein said outer latching member of said first rim has a generally linear cross-section.

4. A plastic food container, comprising:

a lid including a top wall, a continuous lid wall, and a continuous first rim, said lid wall encompassing said top wall and extending downwardly and outwardly from said top wall, said first rim encompassing a lower edge of said lid wall and projecting laterally outwardly therefrom, said first rim including an inner female member, a central male member, and an outer latching member, said central male member encompassing and being integrally connected to said inner female member, said outer latching member encompassing and projecting laterally outwardly from said central male member;

a base including a bottom wall, a continuous base wall, and a continuous second rim, said base wall encompassing said bottom wall and extending upwardly and outwardly from said bottom wall, said second rim encompassing an upper edge of said base wall and projecting laterally outwardly therefrom, said second rim being adapted to latch with said first rim, said second rim including an inner male member and an outer female member, said outer female member encompassing and being integrally connected to said inner male member, said outer female member including an outer peripheral wall forming a plurality of spaced inwardly-projecting tabs;

wherein when said first and second rims are latched to each other, said inner female member of said first rim receives said inner male member of said second rim, said outer female member of said second rim receives both said central male member and said outer latching member of said first rim, and said outer latching member of said first rim latches with said inwardly-projecting tabs to retain said central male member and said outer latching member of said first rim within said outer female member of said second rim;

wherein said inner female member of said first rim and said inner male member of said second rim have an arch-shaped cross-section; and wherein said central male member of said first rim and said outer female member of said second rim have a generally U-shaped cross-section.

5. The container of claim 4, wherein said central male member of said first rim includes a pair of generally vertical opposing first legs and a horizontal first base portion bridging said opposing first legs, one of said first legs leading directly into said inner female member, the other of said first legs being integrally connected to said outer latching member, and wherein said outer female member of said second rim includes a pair of generally vertical opposing second legs and a horizontal second base portion bridging said opposing second legs, one of said second legs leading directly into said inner male member.

6. The container of claim 5, wherein said outer latching member of said first rim has a generally linear cross-section.

7. The container of claim 4, wherein said continuous lid wall extends upwardly above said first and second rims from an inner end of said inner female member.

* * * * *